United States Patent [19]

Reimert

[11] Patent Number: 5,026,097

[45] Date of Patent: Jun. 25, 1991

[54] WELLHEAD APPARATUS

[75] Inventor: Larry E. Reimert, Spring, Tex.

[73] Assignee: Dril-Quip, Inc., Houston, Tex.

[21] Appl. No.: 387,517

[22] Filed: Jul. 28, 1989

[51] Int. Cl.[5] ..... E21B 43/01; F16L 39/00

[52] U.S. Cl. ..... 285/141; 166/208; 166/217; 166/348; 285/321

[58] Field of Search ..... 166/344, 345, 348, 208, 166/217, 237, 242, 821; 285/45, 140, 141; 164/634; 411/909; 403/324, 326, 339; 175/423

[56] References Cited

U.S. PATENT DOCUMENTS

| | | | |
|---|---|---|---|
| 3,437,356 | 4/1969 | Todd et al. | 175/423 |
| 3,918,747 | 11/1975 | Putch | 285/4 |
| 4,181,331 | 1/1980 | Cowan | 285/141 |
| 4,379,488 | 4/1983 | Hamm | 166/217 |
| 4,901,793 | 2/1990 | Weber | 166/68.5 |

*Primary Examiner*—Stephen J. Novosad
*Attorney, Agent, or Firm*—Vaden, Eickenroht, Thompson & Boulware

[57] ABSTRACT

There is disclosed apparatus for use in suspending an inner case within an outer casing of an offshore well at the ocean floor, which includes an outer body adapted to be connected to the outer casing for lowering therewith into a landed position at the ocean floor, a hanger body adapted to be connected to the inner casing for lowering therewith into the bore of the outer hanger body, and first and second circumferentially split rings carried about the hanger body for radial movement with respect thereto between contracted and expanded positions in which they may be moved with the hanger body into and out of the bore and normally expanded expansion in which they are seated within the bore of the outer body to support the hanger body from the outer body.

6 Claims, 4 Drawing Sheets

WELLHEAD APPARATUS

This invention relates generally to wellhead apparatus; and, more particularly, to improvements in wellhead apparatus for use in suspending concentric strings of casing of an offshore well at the ocean floor.

In apparatus of this type, commonly referred to as a "mudline" suspension system, each of a plurality of inner casing strings is lowered into a bore drilled in the ocean floor by means of a hanger to which an upward extension of the casing string is connected. When the hanger is landed within a body or hanger from which the next outer casing string is suspended, cement is circulated down through the extension, hanger, and suspended string, and up into the annulus about the suspended string to anchor it in place. When the well has been tested, the casing extensions may be retrieved, and the hangers at the upper ends of the casing strings capped or closed off at the ocean floor, to permit the drilling rig to be moved to another location. When it is desired to complete the well for production purposes, the cap is removed and casing extensions are lowered into connection with at least the innermost suspended casing strings to tie them back to a production platform at the surface of the water.

The annular spaces between an outermost conductor casing and the next inner casing string, and between certain of the other inner casings, are ordinarily sufficiently large that each string may be suspended from the next outer string by means of a hanger having an outer shoulder adapted to land on a seat on the bore of the body or hanger from which the next outer casing string is suspensed. The shoulder has a bypass therethrough to connect the annular space above and below it for circulation of cement returns, and a running tool connects each hanger to the casing extension.

However, since the annular spaces between the innermost casing strings are much smaller, it has been proposed to suspend them by means of circumferentially split rings which are carried about a hanger body for expansion and contraction between an inner position in which the ring may be lowered with the string into a position within the bore of the next outer body or hanger and an outer position in which a shoulder thereabout is above a landing surface or seat on the bore of the outer body for landing thereon. More particularly, the ring is of such construction that it tends to assume its expanded position, but yields in response to a radially inwardly directed force so as to move to its contracted position.

As shown in U.S. Pat. No. 4,468,055, assigned to the assignee of the present application, the split landing ring is held against upward movement with respect to the hanger body, and, conversely, the hanger body is held against downward movement with respect to the landing ring, by a circumferentially split detent ring carried by the hanger body on the inner side of the landing ring for guided radial movement between a contracted and a normally expanded position. However, when the landing ring has landed on the landing surface in the bore of the body, and the weight of the inner casing string is slacked off, the detent ring is forced inwardly to release the hanger body for movement downwardly with respect to the landing ring until it lands on the ring. As it moves downwardly, a tapered surface on the hanger body forces the landing ring outwardly into seated position and an outer circumferential surface thereabout moves within an inner circumferential surface on the ring so as to hold the landing ring against movement radially inwardly and out of landed position. With the landing ring so held, a shoulder on the hanger body moves downwardly to seat on the landing ring and thus support the hanger body from the landing ring and thus from the outer body.

As also shown in the aforementioned patent, the landing ring has a skirt or locating member which surrounds the detent ring and is of such length as to fit within a recess in the bore of the outer hanger body which is so located to receive the locating member only when the shoulder on the landing ring is above the landing surface in the bore of the outer body. It has been found, however, that mud or other debris in the well bore may accumulate in the recess to prevent the ring, and thus the locating member from expanding outwardly into the recess. Hence, it may be impossible to land the ring and thus support the hanger body at the desired location. It is therefore an object of this invention to provide apparatus of this type in which the hanger body may be landed in the desired location in the bore despite the presence of such debris in the recess.

It has also been found that the split landing ring has a tendency to twist and bind on the hanger body and hence not move to a desired vertical position relative to the body, especially when, because of the skirt or locating member, the ring is of substantial length relative to its diameter. It is therefore another object is to provide this or similar apparatus wherein the ring is prevented from twisting and binding on the body.

These and other objects are accomplished in accordance with the illustrated embodiment of this invention, by apparatus of this type in which first and second upwardly facing landing surfaces as well as an annular recess are formed in the bore of the outer body, and first and second circumferentially split rings are carried about the inner hanger body each for radial movement with respect thereto between contracted and expanded positions. The first ring has a first landing surface and a locating member thereon and is expandable from a contracted position in which it may be moved into and out of the bore to a normally assumed expanded position in which the locating member fits within the recess and the landing shoulder is above the first landing surface for seating thereon. The second ring, on the other hand, has a second landing surface thereon and is expandable between a normally assumed contracted position in which it may be moved into and out of the bore and an expanded position in which the second landing shoulder is above the second landing surface for seating thereon.

The first ring is retained against upward movement with respect to the hanger body, as the body is lowered into the bore, by detent means which is releasable, upon landing of the first ring, to permit the hanger body to be lowered with respect thereto. The second ring is supported from the first ring and the hanger body has means thereon for expanding the second ring into seating position above the second landing shoulder, as the hanger body is lowered with respect to the first and second rings, and then holding the second ring in expanded position and supporting the hanger body from the second ring, as the hanger body is lowered further with respect thereto. More particularly, and in accordance with one novel aspect of this invention, the locating member has sharp edges thereabout for digging into debris within the recess as the first ring expands, whereby the landing shoulder on the first ring is able to expand into a position above the first landing surface under circumstances in which a ring of more conventional construction would be prevented from expanding. Consequently, the operator is assured that the landing shoulder of the first ring will seat upon the first landing surface to permit the hanger body to be lowered with respect thereto in order to force the second ring outwardly to its seated position and hold it therein as it is lowered into supported position thereon. Preferably, the first ring also has a sharp edge thereabout for digging into debris in the bore of the outer body above the first landing surface, thus further facilitating expansion of the first ring in the event debris is in that location as well. As illustrated, the sharp edges are vertically disposed along the locating member.

In accordance with another novel aspect of the present invention, the first ring, which because of the locating member, is quite long compared to its diameter, has a lateral groove therein which opens to one of its free edges, and a tongue which extends from its other free edge and is guidably received in the groove as the ring expands and contracts, whereby the ring is prevented from cocking and thus binding on the inner body.

In the drawings, wherein like reference characters are used throughout to designate like parts:

Figure 1:
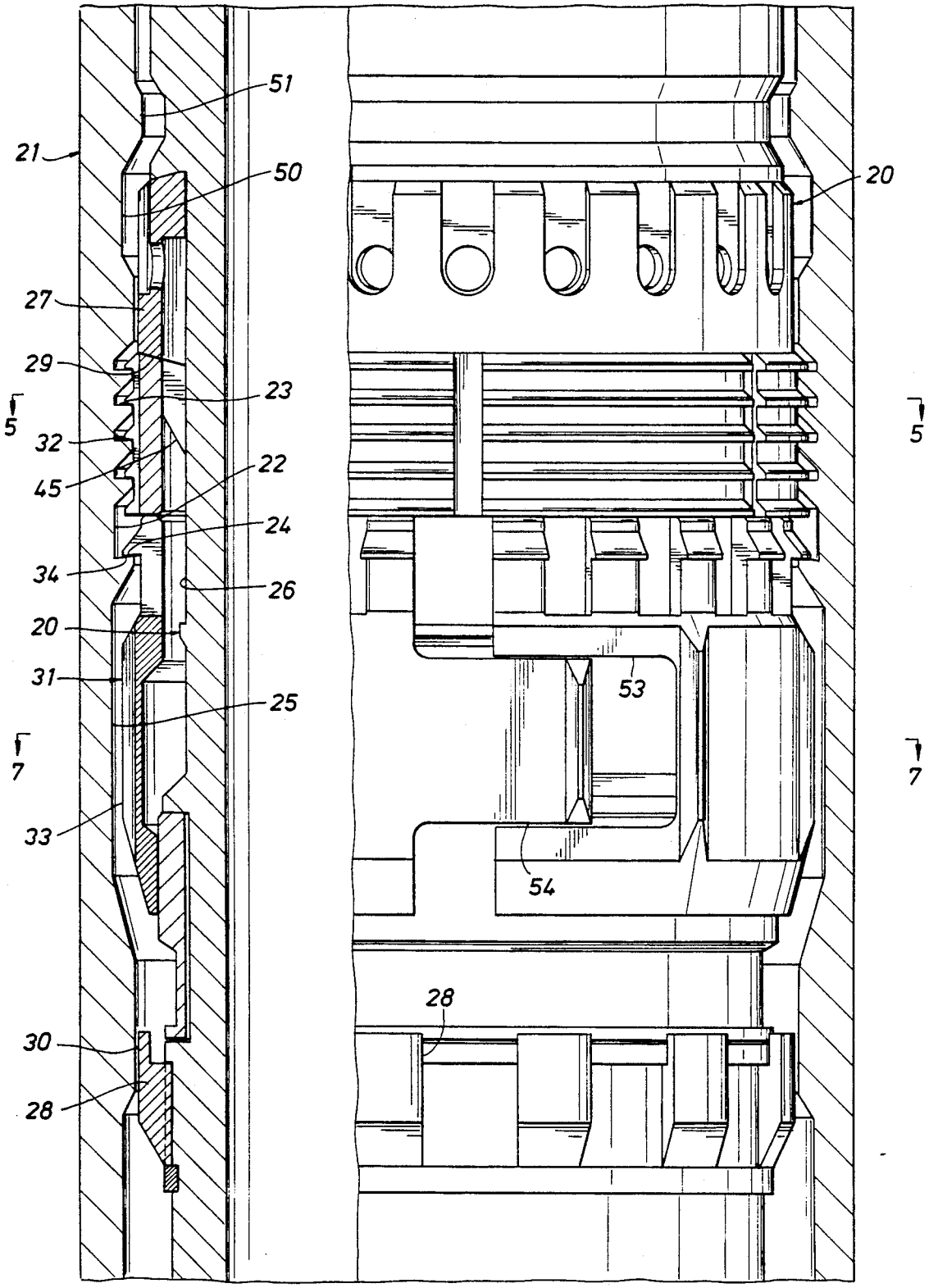
FIG. 1 is a view partly in vertical section and partly in elevation of apparatus constructed in accordance with the present invention and including an inner hanger body and first and second landing rings carried thereabout and landed within the bore of an outer body to support the inner hanger body within the outer body.
Figure 2:
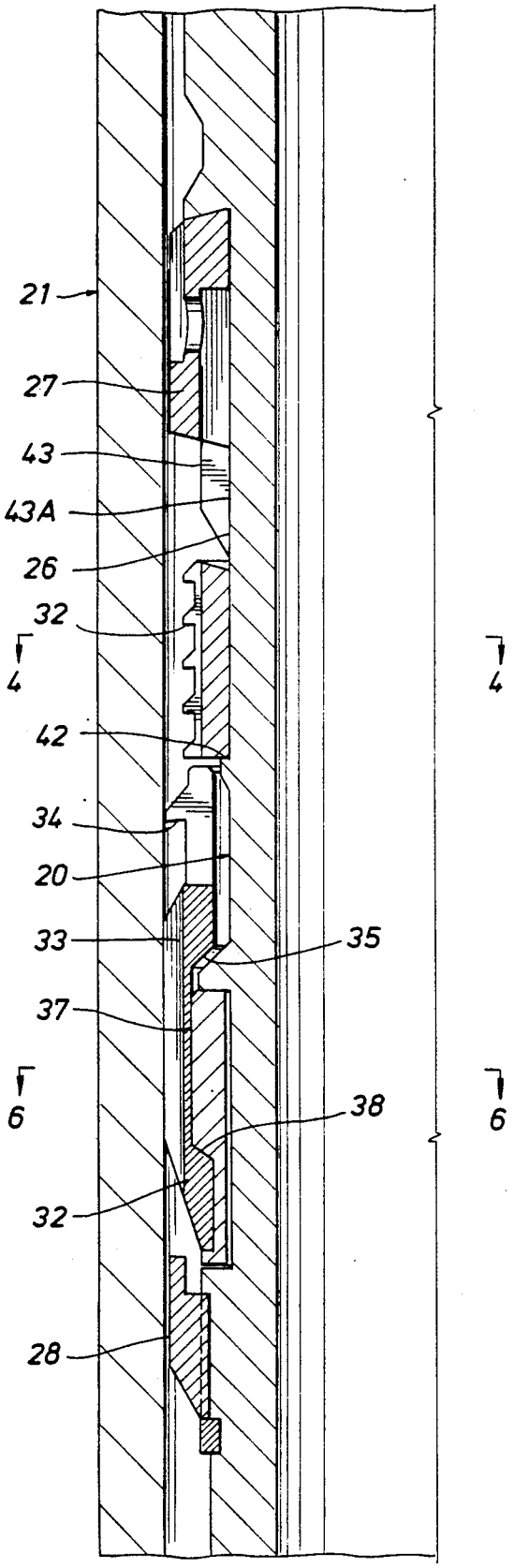
FIG. 2 is a vertical sectional view of the left side of the apparatus of FIG. 1 during lowering of the inner hanger body and landing rings into the bore of the outer body.
Figure 3:
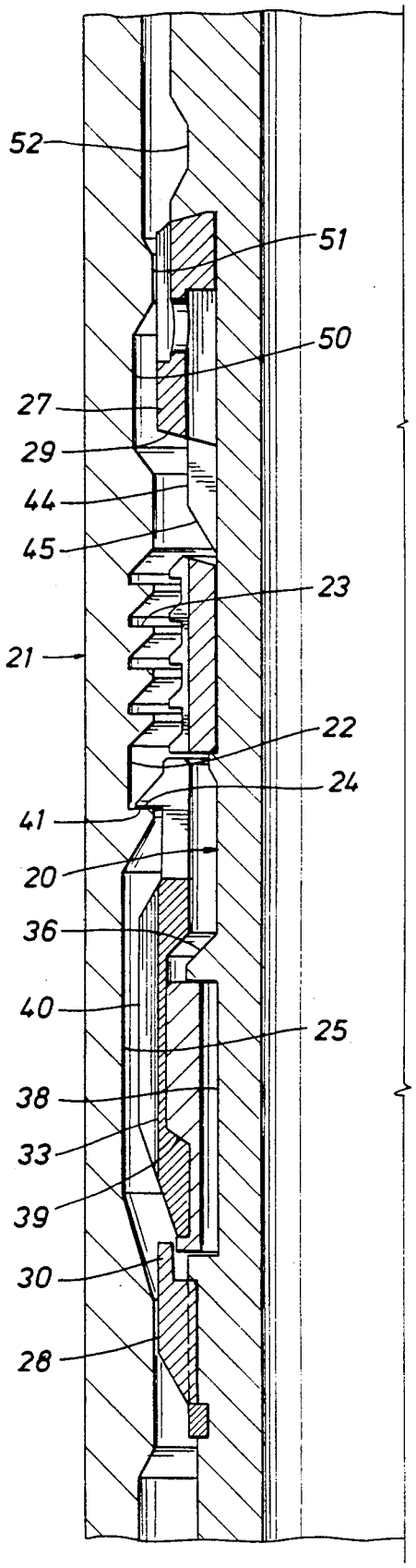
Figure 4:
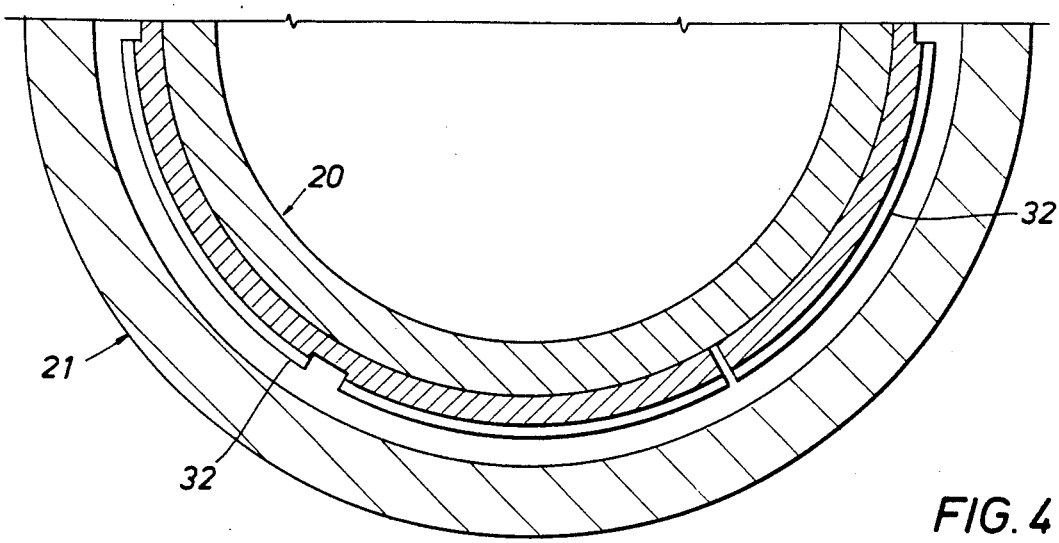
Figure 5:
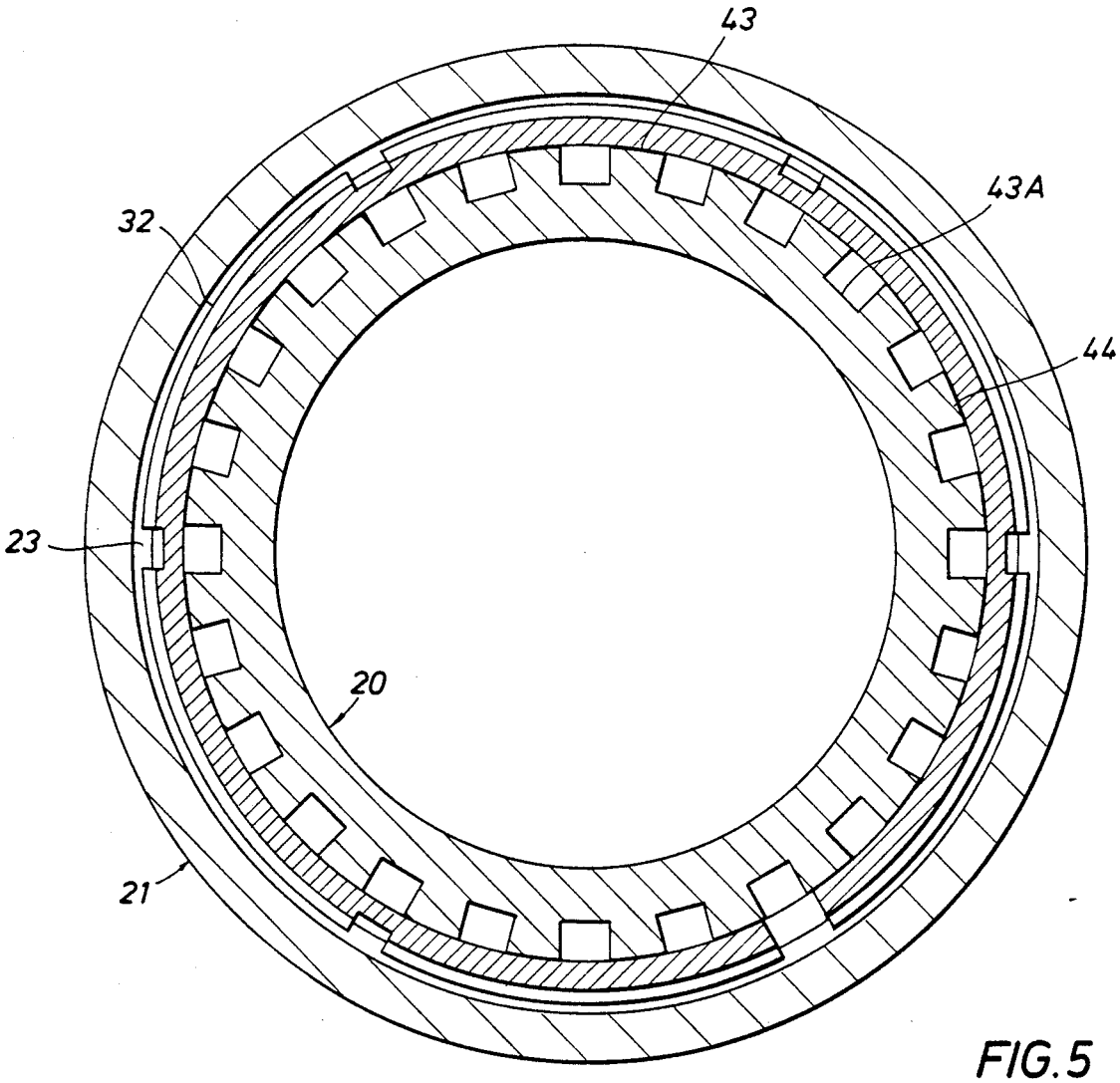
Figure 6:
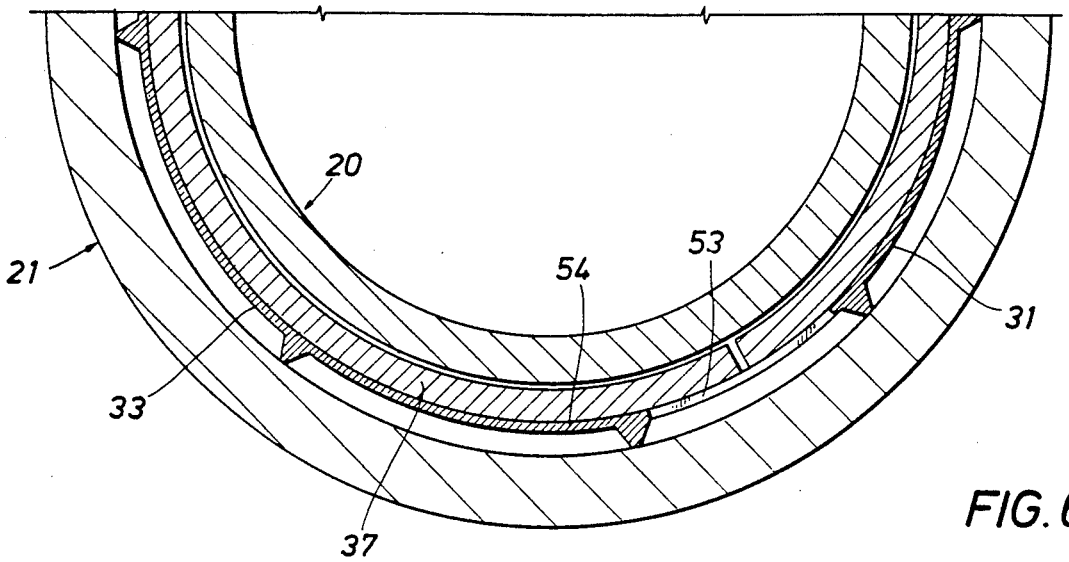
Figure 7:
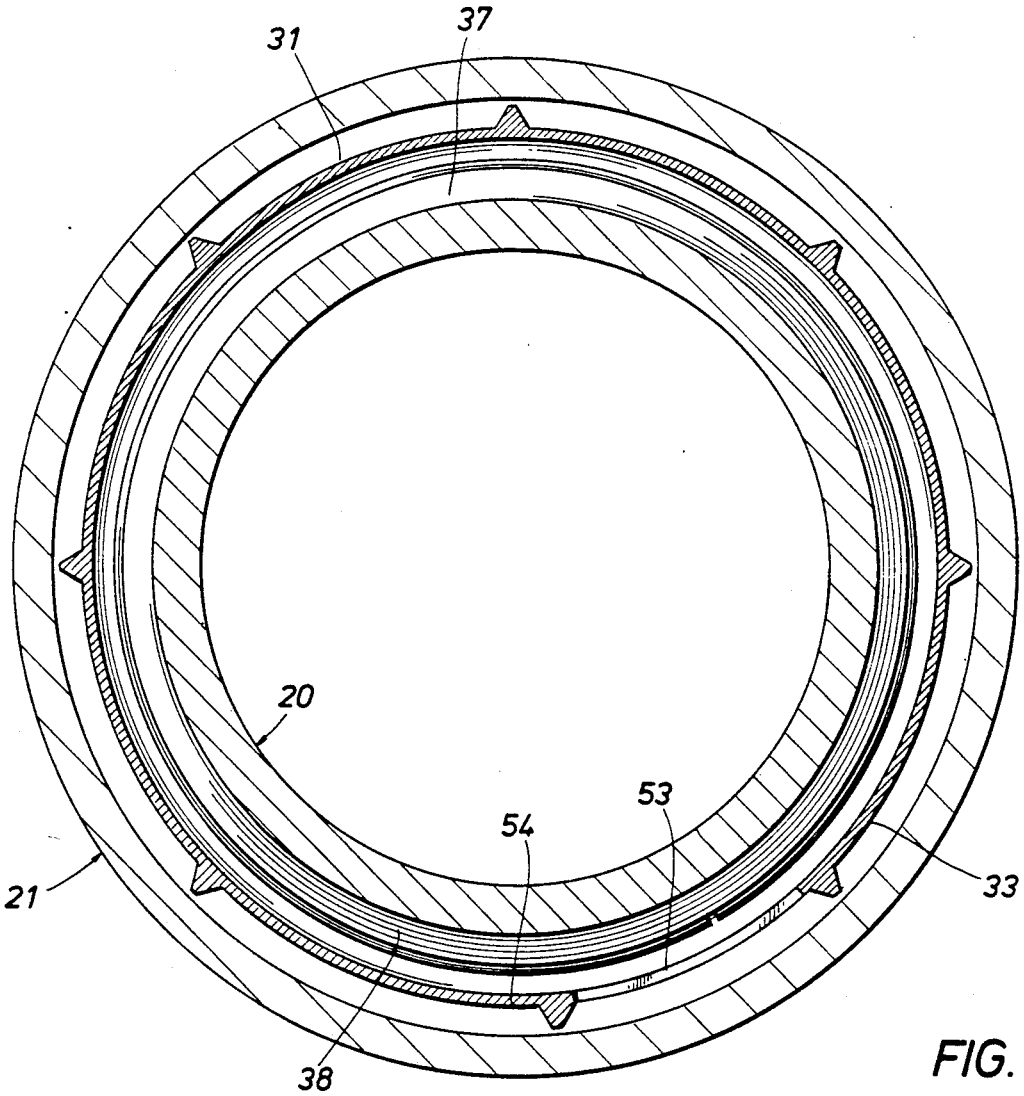

FIG. 3 is a view similar to FIG. 2, but upon expansion of the locating member of the first ring into the recess and the landing shoulder thereof into seated position on the landing surface on the bore of the outer body, but prior to lowering of the hanger body with respect to the first ring so as to force the second ring outwardly into and hold the seated position on the second landing surface in the bore and support the hanger body on the second ring, as shown in FIG. 1;

FIG. 4 is a cross-sectional view of the apparatus, as seen along broken lines 4—4 of FIG. 2;

FIG. 5 is a cross-sectional view of the apparatus, as seen along broken lines 5—5 of FIG. 1, and thus showing the second landing ring in expanded, seated position;

FIG. 6 is a cross-sectional view of the apparatus, as seen along broken lines 6—6 of FIG. 2, and thus showing the first landing ring in its contracted position upon lowering into the bore; and FIG. 7 is a cross-sectional view of the apparatus, as seen along broken lines 7—7 of FIG. 1, and thus showing the first ring in its expanded, seated position within the bore.

With reference now to the details of the above described drawings, the wellhead apparatus is shown in FIG. 1 to comprise a hanger body 20 landed within and supported from an outer body 21 so as to suspend an inner casing (not shown) connected to the lower end of the hanger body within an outer casing (not shown) connected to the lower end of the outer body. As well known in the art, the hanger and casing suspended therefrom have been lowered into supported position by means of a running tool (not shown) connected to the upper end of the inner hanger body.

As also well known in the art, the lower ends of the casings are anchored within well bores by means of columns of cement which may extend upwardly into the annular space between them. Thus, as will be described, the hanger body has flow passages formed in it to connect the annular space between the inner and outer casings above and below the hanger body so as to permit these cement returns to pass upwardly therethrough.

Bore 22 in the outer body 21 has first vertically spaced landing surfaces 23 formed thereabout on the upper sides of vertically spaced teeth projecting inwardly within the bore. A second, upwardly facing landing surface 24 is formed within the bore on the upper side of another tooth extending into the bore beneath the landing surfaces 23, and an annular recess 25 is formed about the bore beneath the tooth on which the second landing surface 24 is formed.

The hanger body 20 has a recess 26 thereabout intermediate a landing head 27 at its upper end and retaining segments 28 about its lower end. The head 27 has a load supporting shoulder 29 about its lower end, and the retaining segments have upstanding lips 30 about their upper ends whose function will be described to follow.

First and second, circumferentially split landing rings 31 and 32 are carried about the hanger body 20 each for expansion and contraction with respect thereto. More particularly, the first ring 31 is disposed beneath the second ring 32 and is so constructed that it normally assumes an expanded position, as shown in FIGS. 1 and 3, while the second ring 32 is of such construction that it normally assumes a contracted position, as shown in FIG. 2. As the hanger body is lowered into the bore of the outer body, the second ring 32 assumes its contracted position at a location spaced beneath the load supporting shoulder 29 of the head 27 of the inner hanger body, and the first ring is held inwardly in its contracted position by engagement with the inner diameter of the outer body above the bore therein.

The first ring 31 has an annular skirt of locating member 33 formed about its lower end and a landing shoulder 34 formed on the lower side of a tooth at its upper end. The outer diameter of the locating member of the first ring is somewhat greater than that of the landing shoulder so that it slides within the inner diameter of the outer body as the first ring is lowered with the hanger body into the bore of the outer body. The second ring 32 has a plurality of vertically spaced teeth thereabout which provide landing shoulders on their lower ends which are spaced from one another distances corresponding to the spacing between landing surfaces 23 on the bore of the outer body.

The locating member 33 is of a length for fitting within the recess 25 in the bore of the outer body, but not within other annular recesses in the inner diameter of the outer body thereabove. More particularly, the recess is so located relative to the landing shoulder 34 that the locating member moves outwardly into the recess when the first ring has been lowered with the inner body into a position in which the landing shoulder 34 at the upper end of the first ring is opposite the landing surface 24.

As the first ring is lowered into the bore of the outer body, it is supported from and thus carried by the inner body by means of a shoulder 35 about its inner diameter disposed above a shoulder 36 within the recess about the hanger body. The first ring is releasably held against upward movement with respect to the hanger body by means of a detent ring 37 guidably movable radially within an annular slot 38 in the recess about the inner body beneath the shoulder 36 thereon. More particularly, the detent ring comprises a circumferentially split ring which is of such construction as to assume an expanded position, and thus be urged outwardly against the inner diameter of the skirt of locating member of the first ring, as shown in FIG. 3, and which has an upwardly facing shoulder 39 at its lower end which is disposed opposite a downwardly facing shoulder 39A about the detent ring 37 so as to hold the first ring against upward movement with respect to the hanger body, and thus, conversely, hold the hanger body against downward movement with respect to the first ring.

As previously described, the locating member has a plurality of vertically disposed sharp edges 40 formed thereabout for digging into debris which might be present within the recess in the bore. As shown in FIGS. 6 and 7, these sharp edges are formed on the outer ends of vertically disposed ribs machined about the outer diameter of the locating member. As also previously described, a sharp edge 41 is disposed about the first ring for digging into debris which might be present in the bore of the outer body above the seating surface 24 therein. More particularly, and as shown in the drawings, this sharp edge is formed on the outer end of the tooth on which landing shoulder 34 is formed.

When contracted, as shown in FIGS. 2 and 3, the second ring 32 is supported from an upwardly facing shoulder 42 about the hanger body above the upper end of the first ring. Thus, during lowering of the apparatus, the second ring is unaffected by the first ring 31, whose upper end is held downwardly beneath it.

The hanger body has an enlarged diameter portion 43 disposed thereabout beneath the head 27 at its upper end but above the upper end of the contracted second ring 32. This enlarged diameter portion 43 has an upper cylindrical portion 44 of lesser diameter than the load supporting surface 29 on the head 27, and an inwardly and downwardly tapered ring expanding surface 45 beneath the cylindrical surface 43.

Shoulders 38 and 39A are tapered downwardly and inwardly, so that, upon landing of the first ring in the position of FIG. 3, and lowering of the hanger body with respect to the landed first ring, the detent ring 37 is forced inwardly to release the hanger body for continued lowering with respect to the first ring. As this occurs, the lower end of the contracted second ring moves downwardly into a supported position on the upper end of the landed first ring, as shown in FIG. 1, and the expanding surface 45 on the hanger body moves within the inner diameter of the second ring to force it outwardly toward its expanded position. Continued lowering of the hanger body will fully expand the second ring to dispose its landing shoulders above the landing surfaces 23 within the bore of the outer body, and cause the cylindrical surface 44 thereon to move within the inner diameter of the second ring to hold it in its landed position. More particularly, final lowering of the hanger body with respect to the first ring will lower the load supporting surface 29 onto the upper end of the second ring, and thus lower the second ring into landed position on the landing surfaces in the bore of the outer body to support the hanger body from the second ring and thus from the outer body.

As shown, the lip 30 on the retaining member 28 extends upwardly past the lower end of the detent ring 37, but below the lower end of the skirt of the first ring. More particularly, and as shown in FIGS. 1 and 3, the lip is so located as to limit radial movement of the detent ring out of recess 38, but permit the first ring to fully expand to its landed position, even though debris may accumulate above the detent ring within the lip.

As will be apparent from the drawings, flow passages 43A are formed in the enlarged diameter portion 43 of the inner body as well as in the head 27 to permit free flow between the hanger body and outer body. Toward this same end, vertical slots are formed in the outer diameter of the second ring as well as in the upper end of the first ring and wide passageways are formed between the retaining segments (See FIG. 1).

An annular recess 50 is formed in the bore of the outer body above the landing surfaces 23 thereon in such position as to be generally opposite an outer recessed portion of the head 27 of the hanger body when the hanger body is in its landed position, as shown in FIG. 1, so as to provide a continuation of the flow passages formed in the hanger body. At the same time, a reduced inner diameter portion 51 is formed in the outer body above the recess 50 so as to guide the enlarged head 27 of the hanger body as it moves downwardly therepast, as shown in FIG. 2. In like manner, a recess 52 is formed about the hanger body above the head in such position as to be disposed opposite the reduced diameter portion 51 when the hanger body is landed, thus providing an upper continuation of the flow passage.

As best shown in FIG. 1, a groove 53 is formed in the skirt or locating member of the first ring and opens onto one free edge thereof, and a tongue 54 extends from the other free edge of the skirt and is closely received within the groove. More particularly, the tongue is of such extent that it will be guidably slidable within the groove as the skirt expands and contracts. As previously described, this prevents the skirt and thus the first ring from cocking and thus binding with respect to the hanger body.

Reviewing now the overall operation of the above described apparatus, the first ring 31 will, upon reaching the level shown in FIG. 3, expand outwardly to dispose its landing shoulder 34 above the landing surface 24 on the bore of the outer body. As the first ring moves outwardly, it is followed by the detent ring, thus supporting the hanger body from the first ring. At this time, the weight of the hanger body and its suspended casing are slacked off to wedge the detent ring inwardly to permit the inner hanger to move downwardly with respect to the first ring.

As the hanger body moves downwardly, the second ring 32 is lowered onto the upper end of the first ring, and the expanding surface 45 moves downwardly and behind the second ring to force it outwardly to the expanded position of FIG. 1. Continued downward movement of the hanger body will move the load shoulder 29 onto the upper end of the second ring, thus seating the landing shoulders of the second ring on the landing surfaces 23 in the bore of the outer body, and thus to support the hanger body from the second ring.

The apparatus may be retrieved merely by lifting of the hanger body to permit the second ring to contract inwardly to its normally assumed contracted position. Upward movement of the hanger body also moves the detent ring into a position opposite the outwardly recessed portion of the first ring, as shown in FIG. 3, whereby the continued upward movement of the hanger body will cause the first ring to be forced inwardly to its contracted position, as shown in FIG. 2, as the hanger body continues to move upwardly.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for use in suspending an inner casing within an outer casing of an offshore well at the ocean floor, comprising an outer body having a bore therethrough with a recess thereabout and first and second upwardly facing landing surfaces therein and adapted to be connected to the outer casing for lowering therewith into a landed position at the ocean floor, a hanger body having a recess thereabout and adapted to be connected to the inner casing for lowering therewith into the bore of the outer hanger body, first and second circumferentially split rings carried about the hanger body for radial movement with respect thereto between contracted and expanded positions, said first ring having a first landing shoulder and a locating member thereon and being movable between a contracted position in which it may be moved into and out of the bore and normally assumed expanded position in which the locating member fits within the recess of said outer body and the landing shoulder is above the first landing surface for seating thereon, said second ring having a second landing shoulder thereon and being movable between normally assumed contracted position in which it may be moved into and out of the bore and an expanded position in which the second landing shoulder is above the second landing surface for seating thereon, and detent means retaining the first ring against upward movement with respect to the hanger body as the body is lowered into the bore, but releasable, upon landing of the first ring, to permit the hanger body to be lowered with respect thereto, said second ring being supported from the first ring and said hanger body having means thereon for expanding the second ring into seating position above the second landing shoulder, as the hanger body is lowered with respect to the first and second rings, and then holding the second ring in expanded position and supporting the hanger body from the second ring, as the hanger body continues to be lowered with respect to the rings, and said locating member having ribs with sharp outer edges thereabout for digging into debris within the recess of said outer body as the first ring expands.

2. Apparatus of the character defined in claim 1, wherein said ribs with sharp edges are vertically disposed along the locating member.

3. Apparatus of the character defined in claim 1, wherein said first landing shoulder has a thin sharp edge thereabout for digging into debris within the bore of the outer body about the first landing surface.

4. Apparatus of the character defined in claim 2, wherein said first landing shoulder has a thin sharp edge thereabout for digging into debris within the bore of the outer body about the first landing surface.

5. Apparatus of the character defined in claim 1, wherein said second ring is carried above the first ring.

6. Apparatus for use in suspending an inner casing within an outer casing of an offshore well at the ocean floor, comprising an outer body having a bore therethrough with an upwardly facing landing surface therein and adapted to be connected to the outer casing for lowering therewith into a landed position at the ocean floor, an inner hanger body including a tubular body adapted to be connected to the inner casing for lowering therewith into the bore of the outer body, and a circumferentially split ring having a landing shoulder thereon and being carried about the hanger body for radial movement with respect thereto between a contracted position in which it may be moved into and out of the bore and an expanded position in which the landing shoulder is above the landing surface for seating thereon, said ring having a lateral groove therein which opens to one free edge and a tongue extending from the other free edge and guidably received in the groove as said ring expands and contracts.

* * * * *